US006726019B2

(12) United States Patent
Leung

(10) Patent No.: US 6,726,019 B2
(45) Date of Patent: Apr. 27, 2004

(54) DISPLAY AND CARRYING CASE FOR A DOLL AND DOLL ACCESSORIES

(76) Inventor: Bede Ho Fung Leung, Flat B, 3/F., Block H 80, King's Park Hill Road, Kowloon (HK)

( * ) Notice: Subject to any disclaimer, the term of this patent is extended or adjusted under 35 U.S.C. 154(b) by 31 days.

(21) Appl. No.: 10/175,949

(22) Filed: Jun. 21, 2002

(65) Prior Publication Data

US 2003/0234186 A1 Dec. 25, 2003

(51) Int. Cl.[7] ..... B65D 25/54
(52) U.S. Cl. ..... 206/769; 206/776; 206/782
(58) Field of Search ..... 206/216, 776, 206/782, 775, 478, 97, 769, 771, 579; 383/38–40; 220/528, 529, 662; 446/71, 72, 75

(56) References Cited

U.S. PATENT DOCUMENTS 3,100,642 A * 8/1963 Goldstein ..... 206/579
3,324,997 A * 6/1967 Bonanno ..... 206/765
3,406,816 A * 10/1968 Green ..... 446/73
3,811,565 A * 5/1974 Tancredi ..... 206/478
4,114,313 A * 9/1978 Guerrero et al. ..... 446/191
5,350,058 A * 9/1994 Keough ..... 220/505
5,549,373 A * 8/1996 Bustos ..... 312/135
5,934,551 A 8/1999 Kaufman
5,980,352 A * 11/1999 Rigberg ..... 446/73
6,244,439 B1 6/2001 Dennis
6,328,158 B1 * 12/2001 Bisbal et al. ..... 206/223
6,471,060 B1 * 10/2002 Leyshon ..... 206/473

* cited by examiner

*Primary Examiner*—Jacob K. Ackun
*Assistant Examiner*—Faye Francis
(74) *Attorney, Agent, or Firm*—Stites & Harbison, PLLC; Ross F. Hunt, Jr.

(57) ABSTRACT

A display and carrying case for a doll, a doll clothing ensemble and doll accessories is provided which includes a container defining an interior compartment and including transparent side walls. A handle is attached to the top member of the container. The container includes a zipper fastener for, when unzipped, permitting lifting and pivoting of the top member away from the transparent side walls so as to provide access to the interior compartment of the carrying case. An insert of an x-shaped cross section is disposed in the interior compartment of the container so as to divide the interior compartment into a plurality of sub-compartments. A doll and various doll accessories are separately disposed in different ones of the sub-compartments so as to be visible through the transparent side walls.

15 Claims, 1 Drawing Sheet

DISPLAY AND CARRYING CASE FOR A DOLL AND DOLL ACCESSORIES

FIELD OF THE INVENTION

The present invention relates to carrying and display cases, and more particularly, to a display and carrying case suitable for carrying and separately displaying a doll, and a clothing ensemble for the doll as well as doll accessories.

BACKGROUND OF THE INVENTION

Numerous advertising and marketing techniques are used to enhance the sale of retail products to consumers. One technique that has proven profitable in retail sales is the presentation of products in a manner that is visually appealing to the consumer. Many consumers desire to gather as much information about a product as possible and efforts have been made to visually display products in a manner which assists the consumers in making an informed purchase. Packaging containers are commonly constructed to meet this goal through the provision of transparent windows or large openings that enable the product to be viewed therethrough. One drawback of such prior art containers is that they are usually constructed for displaying and storing a single product or object and not capable of displaying multiple products or objects.

One prior art container or case of interest here is described in U.S. Pat. No. 5,934,551 to Kaufman. The Kaufman patent discloses a rectangular container comprising four sides, a top end, and a bottom end. Each of the four sides includes a window. The container further comprises a partition that divides the container into four quadrants. Each quadrant includes a shelf suitable for supporting an object and a storage space for a book, such that both the object and book are visible through the window. In addition, a string is attached to top end in order to facilitate carrying of the container.

Another prior art container of interest is described in U.S. Pat. No. 6,244,439 to Dennis. The Dennis patent discloses a portable storage container for storing dolls. The container includes a variety of inserts for dividing the container into a plurality of compartments, doors that open into each compartment, an upper storage space or area disposed above each compartment, and further doors that open into each of the upper storage spaces, together with a carrying strap.

SUMMARY OF THE INVENTION

As indicated above, the present invention is particularly concerned with a case for carrying and displaying a doll as well as clothing and accessories for the doll and, more specifically, with a case for this purpose that provides a full unobstructed view of the doll and other items when viewed from the exterior of the carrying case. Moreover, the carrying and display case of the invention is of a sturdy, rugged construction which lends itself to use by young children and which is relatively simple and inexpensive to make. In addition, the case construction is such as to provide ready access to the contents thereof without loss of case sturdiness and to this end, the case includes a zipper fastener which securely contains the contents within the carrying case and also permits easy access to the interior compartments of the carrying case.

In accordance with one aspect of the invention, there is provided a display and carrying case for a doll and doll accessories, said carrying case comprising:

a container defining an interior compartment and comprising a top member, a bottom member and transparent side walls defining a lateral perimeter; a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment; a handle attached to said container for carrying said container; and a partition, disposed in said interior compartment in said container and comprising a plurality of radiating members radiating from a central point, for dividing said interior compartment into a plurality of sub-compartments defined between adjacent radiating members such that a doll and doll accessories separately disposed in different ones of said sub-compartments can be viewed through said side walls.

Advantageously, the transparent side walls comprise clear vinyl walls and the container is of a rectangular shape having four sides.

Preferably, the zipper fastener is affixed to three sides of said four sides and the partition comprises a separate insert comprising four radiating members, said insert being disposed in said interior compartment of said container so as to divide said interior compartment into four sub-compartments, each facing one of said four sides.

Advantageously, a doll is received in one of said sub-compartments so as to be visibly displayed on one of said four sides. In addition, at least one item of doll clothing ensemble is received in a second of said sub-compartments so as to be visibly displayed on a second side of said four sides, and at least one doll accessory is received in a third and a fourth of said sub-compartments so as to be visibly displayed on third and fourth sides of said four sides.

In another embodiment of the present invention, the container is of a round shape having a round side wall and said sub-compartments face a convex curved portion of said side wall.

Preferably, the partition comprises a separate insert comprising four radiating members, said insert being disposed in said interior compartment of said container so as to divide said interior compartment into four sub-compartments.

Advantageously, a doll is received in one of said sub-compartments so as to be visible through a respective convex curved portion of said side wall. In addition, at least one item of doll clothing ensemble is received in a second of said sub-compartments so as to be visible through a respective convex curved portion of said side wall, and at least one doll accessory is received in third and fourth of said sub-compartments so as to be visible through a respective convex curved portion of said side wall.

In accordance with a further aspect of the invention, there is provided, in combination, a doll, doll accessories for the doll and a carrying and display case therefor, comprising: a rectangular container defining an interior compartment and comprising an opaque top member, and an opaque bottom member and four transparent sides defining a lateral perimeter; a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment; a handle attached to said top member of said container for carrying said container; a separate cardboard insert of an x-shaped transverse cross section for partitioning said interior compartment into four triangular quadrants, each facing one of said four sides; a doll disposed in one quadrant of said four quadrants so that said doll is visible through one of said four transparent sides; a clothing ensemble for said doll, disposed in a second quadrant of said four quadrants so that said clothing ensemble is visible through a second of said four sides; and doll accessories disposed in a third and a fourth of said four quadrants so that said doll accessories are visible through said third and said fourth side of said four sides.

In accordance with another aspect of the invention, there is provided, in combination, a doll, doll accessories for the doll and a carrying and display case thereof, comprising: a container having a round side wall formed of transparent material, a top member and a bottom member defining an interior compartment; a zipper fastener provided in an upper portion of said container substantially adjacent to said top member and extending at least partially around the side wall of the container for, when unzipped, permitting lifting and pivoting of said top member away from a portion of said side wall so as to provide access to said interior compartment; a handle attached to said container for carrying said container; a separate cardboard insert of an x-shaped transverse cross section for partitioning said interior compartment into four quadrants, each quadrant facing a convex curved portion of said side wall; a doll disposed in one quadrant of said four quadrants so that said doll is visible through a respective convex curved portion of said side wall; a clothing ensemble for said doll, disposed in a second quadrant of said four quadrants so that said clothing ensemble is visible through a respective convex curved portion of said side wall; and doll accessories disposed in a third and a fourth of said four quadrants so that said doll accessories are visible through a third and a fourth respective convex curved portion of said side wall.

Further features and advantages of the present invention will be set forth in, or apparent from, the detailed description of preferred embodiments thereof which follows.

DETAILED DESCRIPTION OF THE PREFERRED EMBODIMENTS

Figure 1:
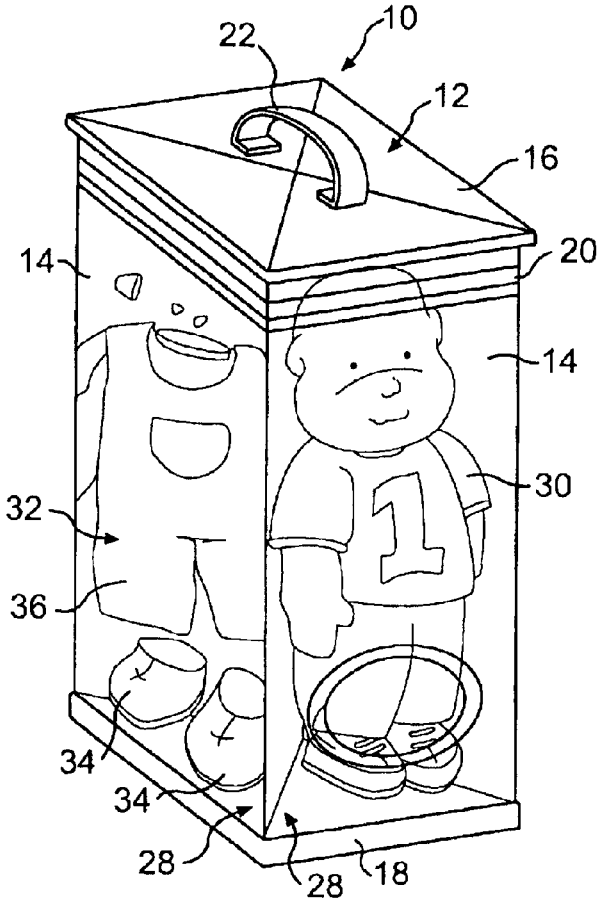
FIG. 1 is a perspective view of a display and carrying case for a doll, doll clothing ensemble and doll accessories in accordance with a first preferred embodiment of the present invention.
Figure 3:
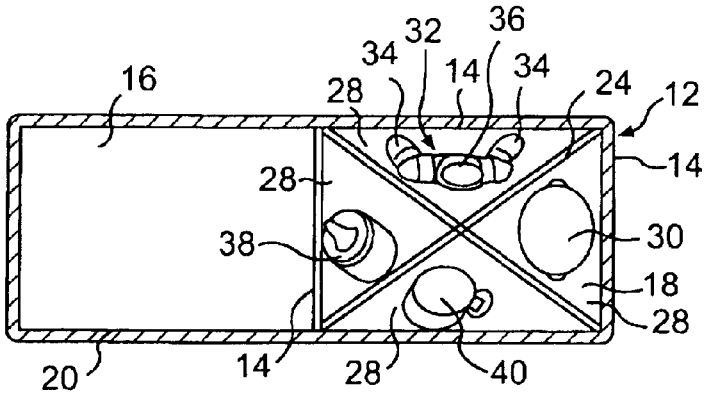
FIG. 3 is a top plan view of the embodiment of FIG. 1, with the top portion pivoted to one side.

Referring to FIGS. 1 and 3, a first embodiment of the invention is shown. In accordance with this embodiment, there is provided a rectangular display and carrying case for a doll and doll accessories, which is generally denoted 10, and which includes a case or container body 12 that defines an interior space. Container body 12 includes four transparent side walls 14 (two of which are shown in FIG. 1), a top or upper member 16 and a bottom or base member 18.

The carrying case 10 also includes a zipper fastener 20 provided in an upper portion of the container body 12 substantially adjacent to the top member 16. The zipper fastener 20 extends partially around the lateral perimeter of the container 12, and, in this embodiment, is affixed to three of the four transparent side walls 14 so that, as shown in FIG. 3, the top member 16 is hingeably attached to the remaining one of the four transparent side walls 14. Thus, when the zipper fastener 20 is unzipped thus disconnecting the top member 16 on three sides from the remainder of container body 12, the top member 16 can be pivoted away from the transparent side walls 14 in order to provide ready access to the interior of the container 12.

A U-shaped handle 22 is securely attached at opposite ends thereof to top member 16 of the container body 12 in order to facilitate the carrying of the container 12.

The transparent side walls 14 are preferably made of clear vinyl, although other transparent materials can be used, such as polyurethane, polystyrene, or acetate.

In one preferred embodiment, the top member 16 and bottom member 18 comprise opaque materials of suitable colors. However, it will be appreciated that the top member 16 and bottom member 18 can also be transparent and can be constructed from clear vinyl or from any suitable transparent material.

As can best be seen in FIG. 3, the container 12 includes an insert 24 which is suitable as a partition. The insert 24 is of an x-shaped transverse cross section and can be viewed as comprising four members that radiate from a central point. The insert 24 is disposed in the interior of the container 12 so as to divide the interior compartment into four triangular sub-compartments 28. Each one of the triangular sub-compartments 28 faces one of the four transparent side walls 14. Although insert 24 is preferably constructed of cardboard, it will be appreciated that the insert 24 can be constructed from any suitable material, such as plastic, fiberboard, pasteboard, light wood or the like.

Although in the preferred embodiment, four triangular sub-compartments are provided, an insert having additional radiating members may be employed so as to provide additional sub-compartments if desired. For example, an insert having six radiating members would provide six sub-compartments when the insert was disposed in the interior of the container.

As shown in FIGS. 1 and 3, a doll 30 is received in one of the sub-compartments 28 so that the doll 30 can be viewed through a corresponding one of the transparent side walls 14. In addition, a doll clothing ensemble 32, including, in the example illustrated, shoes 34 and shirt and coveralls outfit 36, is received in a second of the sub-compartments 28 so that the clothing ensemble 32 can be seen through a further one of the transparent side walls 14. Further, doll accessories, in the form of a bottle 38 and a rattle 40, are received in a third and a fourth of the sub-compartments 28 so as to be visible through the third and fourth side of the container 12, through a corresponding third and fourth side wall of the transparent side walls 14. It will be appreciated that different items or sets of items can occupy different sub-compartments 28 and that, for example, clothes for the doll can be displayed in three of the four compartments depending on the desires of the original packager or the ultimate purchaser or user.

Figure 2:
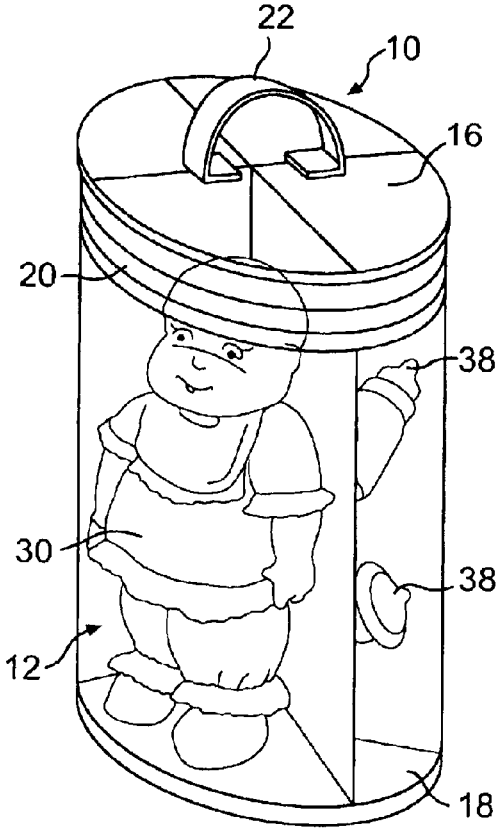
FIG. 2 is a perspective view of a display and carrying case for a doll, doll clothing ensemble and doll accessories in accordance with a second preferred embodiment of the present invention.

Referring to FIG. 2, a further preferred embodiment of the invention is shown. This embodiment is similar to that of FIG. 1 and like elements have been given the same reference numbers. The embodiment of FIG. 2 differs from that of FIG. 1 principally in that the display and carrying case 10 of FIG. 2 is of a round shape having a transparent side wall 14 that is convex curved. Each of the sub-compartments 28 faces a portion of the side wall 14.

It will be appreciated that the display and carrying case 10 provides an unobstructed view of the doll 30 and the various doll accessories from the exterior of the case 10. Further, the display and carrying case 10 is also sturdy and durable, and serves to protect the contents thereof from rain, dirt, and the like. In addition, the zipper fastener 20 of the display and carrying case 10 provides an advantageous way in which to provide access to the doll and doll accessories in that the zipper 20, when zipped up, maintains, and contributes to, the sturdiness of the container body 20 and, when unzipped, provides ready access to the contents. Of course, zipper 20 can be easily operated by a child which is also important here.

Although the invention has been described above in relation to preferred embodiments thereof, it will be understood by those skilled in the art that variations and modifications can be effected in these preferred embodiments without departing from the scope and spirit of the invention.

What is claimed is:

1. A display and carrying case for a doll and doll accessories, said carrying case comprising:

a container defining an interior compartment and comprising a top member, a bottom member and transparent side walls defining a lateral perimeter;

a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment;

a handle attached to said container for carrying said container; and a partition, disposed in said interior compartment in said container and comprising a plurality of radiating members radiating from a central point, for dividing said interior compartment into a plurality of sub-compartments defined between adjacent radiating members such that a doll and doll accessories separately disposed in different ones of said sub-compartments can be viewed through said side walls.

2. A carrying case according to claim 1, wherein said transparent side walls comprise clear vinyl walls.

3. A carrying case according to claim 2, wherein said container is of a rectangular shape having four sides.

4. A carrying case according to claim 3, wherein said zipper fastener is affixed to three sides of said four sides.

5. A carrying case according to claim 4, wherein said partition comprises a separate insert comprising four radiating members, said insert being disposed in said interior compartment of said container so as to divide said interior compartment into four sub-compartments, each facing one of said four sides.

6. A carrying case according to claim 5, wherein a doll is received in one of said sub-compartments so as to be visibly displayed on one of said four sides.

7. A carrying case according to claim 5, wherein at least one item of doll clothing ensemble is received in a second of said sub-compartments so as to be visibly displayed on a second side of said four sides.

8. A carrying case according to claim 5, wherein at least one doll accessory is received in a third and a fourth of said sub-compartments so as to be visibly displayed on third and fourth sides of said four sides.

9. A carrying case according to claim 2, wherein said container is of a round shape having a round side wall and said sub-compartments face a convex curved portion of said side wall.

10. A carrying case according to claim 9, wherein said partition comprises a separate insert comprising four radiating members, said insert being disposed in said interior compartment of said container so as to divide said interior compartment into four sub-compartments.

11. A carrying case according to claim 10, wherein a doll is received in one of said sub-compartments so as to be visible through a respective convex curved portion of said side wall.

12. A carrying case according to claim 10, wherein at least one item of doll clothing ensemble is received in a second of said sub-compartments so as to be visible through a respective convex curved portion of said side wall.

13. A carrying case according to claim 10, wherein at least one doll accessory is received in third and fourth of said sub-compartments so as to be visible through a respective convex curved portion of said side wall.

14. In combination, a doll, doll accessories for the doll and a carrying and display case therefor, comprising:

a rectangular container defining an interior compartment and comprising an opaque top member, and an opaque bottom member and four transparent sides defining a lateral perimeter;

a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment;

a handle attached to said top member of said container for carrying said container;

a separate cardboard insert of an x-shaped transverse cross section for partitioning said interior compartment into four triangular quadrants, each facing one of said four sides;

a doll disposed in one quadrant of said four quadrants so that said doll is visible through one of said four transparent sides;

a clothing ensemble for said doll, disposed in a second quadrant of said four quadrants so that said clothing ensemble is visible through a second of said four sides; and doll accessories disposed in a third and a fourth of said four quadrants so that said doll accessories are visible through said third and said fourth side of said four sides.

15. In combination, a doll, doll accessories for the doll and a carrying and display case thereof, comprising:

a container having a round side wall formed of transparent material, a top member and a bottom member defining an interior compartment;

a zipper fastener provided in an upper portion of said container substantially adjacent to said top member and extending at least partially around the side wall of the container for, when unzipped, permitting lifting and pivoting of said top member away from a portion of said side wall so as to provide access to said interior compartment;

a handle attached to said container for carrying said container;

a separate cardboard insert of an x-shaped transverse cross section for partitioning said interior compartment into four quadrants, each quadrant facing a convex curved portion of said side wall;

a doll disposed in one quadrant of said four quadrants so that said doll is visible through a respective convex curved portion of said side wall;

a clothing ensemble for said doll, disposed in a second quadrant of said four quadrants so that said clothing ensemble is visible through a respective convex curved portion of said side wall; and doll accessories disposed in a third and a fourth of said four quadrants so that said doll accessories are visible through a third and a fourth respective convex curved portion of said side wall.

* * * * *